US009644435B2

(12) United States Patent
Naumann

(10) Patent No.: US 9,644,435 B2
(45) Date of Patent: May 9, 2017

(54) METHODS FOR INJECTING OR RETRIEVING TUBEWIRE WHEN CONNECTING TWO STRINGS OF COILED TUBING

(71) Applicant: Baker Hughes Incorporated, Houston, TX (US)

(72) Inventor: Andre Naumann, Calgary (CA)

(73) Assignee: BAKER HUGHES INCORPORATED, Houston, TX (US)

( * ) Notice: Subject to any disclaimer, the term of this patent is extended or adjusted under 35 U.S.C. 154(b) by 298 days.

(21) Appl. No.: 14/273,422

(22) Filed: May 8, 2014

(65) Prior Publication Data

US 2015/0322732 A1 Nov. 12, 2015

(51) Int. Cl.
*E21B 17/20* (2006.01)

(52) U.S. Cl.
CPC ..... *E21B 17/20* (2013.01); *E21B 17/206* (2013.01)

(58) Field of Classification Search
CPC ..... E21B 17/20; E21B 17/206; H02G 1/08; H02G 1/085; H02G 1/086; H02G 1/081
See application file for complete search history.

(56) References Cited

U.S. PATENT DOCUMENTS 4,529,148 A * 7/1985 Hesprich ..... B65H 55/00 138/103
7,845,419 B2 12/2010 Naumann
2008/0169094 A1* 7/2008 Ehtesham ..... E21B 17/046 166/77.2
2008/0265081 A1* 10/2008 Laun ..... B65H 75/4405 242/397.3
2010/0096124 A1* 4/2010 Naumann ..... E21B 17/206 166/250.01
2012/0211231 A1* 8/2012 Erkol ..... E21B 17/028 166/338

OTHER PUBLICATIONS

Dictionary definition of "inject", accessed on Apr. 27, 2016 via www.thefreedictionary.com.*

* cited by examiner

*Primary Examiner* — Blake Michener
*Assistant Examiner* — Manuel C Portocarrero
(74) *Attorney, Agent, or Firm* — Shawn Hunter

(57) ABSTRACT

Systems and methods for injecting tubewire into the core end of coiled tubing sections on reels. Methods are described for disposing tubewire into multiple sections of coiled tubing.

18 Claims, 7 Drawing Sheets

METHODS FOR INJECTING OR RETRIEVING TUBEWIRE WHEN CONNECTING TWO STRINGS OF COILED TUBING

BACKGROUND OF THE INVENTION

1. Field of the Invention

The invention relates generally to devices and methods used to dispose tubewire into and remove it from radially surrounding tubing strings. In particular aspects, the invention relates to the insertion and removal of tubewire in situations wherein separate strings of coiled tubing are being connected.

2. Description of the Related Art

Coiled tubing has become a popular means for running a bottom hole assembly ("BHA") or other tools into a subterranean wellbore. In most cases, it is desirable to be able to transmit electrical power down to the BHA or other tools as well as to permit control signals or sensed data to be transmitted between the surface and the downhole tools. Conventionally, this is done by disposing wireline into the coiled tubing. Wireline is a braided steel cable with layers of armor with conductors inside.

Use of wireline can be problematic. Wireline is prone to damage from acidic fluids in some instances. The slack in wireline must be adjusted over time, which requires time and money.

Tubewire is an alternative to wireline and has many advantages over wireline. Tubewire can be disposed inside coiled tubing to provide electrical power and a signal path from the surface to various downhole tools attached to the end of the coiled tubing. Tubewire is a tube that contains an insulated wire that is used to provide electrical power and/or data to the bottom hole assembly or to transmit data from the BHA to the surface. Tubewire is substantially inflexible relative to wireline. Tubewire is available commercially from manufacturers such as Draka Cableteq of North Dighton, Mass.

Tubewire can be disposed into coiled tubing at the surface. Systems and methods for injecting and retrieving tubewire into and out of coiled tubing are discussed in U.S. Pat. No. 7,845,419 by Naumann, which is incorporated herein by reference in its entirety. While the coiled tubing is spooled up on a reel at surface, the tubewire is placed into the coiled tubing by pumping fluid through the coiled tubing at high flow rates while an injector is used to feed the tubewire into the coiled tubing by applying a pushing force. According to the '419 patent, tubewire is pumped into the whip end (i.e., the end of the coiled tubing furthest away from the center of the reel) of the coiled tubing and toward the core end (i.e., the end of the coiled tubing nearest the center of the reel).

In many scenarios, such as off-shore situations, there are weight restrictions on equipment used to handle reels of coiled tubing, such as cranes. For this reason, a number of separate reels of coiled tubing are often used. These are moved one at a time by the crane or other handling equipment to a staging area for injection into the wellbore. The separate coiled tubing sections are joined together, then spooled up onto one reel and then injected into the wellbore from a single reel.

SUMMARY OF THE INVENTION

The present invention provides devices and methods that allow tubewire to be injected into and/or removed from coiled tubing in situations wherein there are two separate reels of coiled tubing which are to be connected together. This situation could occur on land or offshore. The invention describes devices and methods for disposing tubewire into (or removing the tubewire from) the core end of a section of coiled tubing on a reel. A conduit, such as a high pressure hose, as well as a tee and treating iron are affixed to the core end of the coiled tubing section to facilitate injection of tubewire into the core end. The procedures for disposing tubewire into, or retrieving tubewire from, coiled tubing section are preferably performed at surface, with the coiled tubing sections on either one reel or two. It is further noted that the devices, techniques and methods described herein could also be applied where there are three, four or even more separate sections of coiled tubing involved.

The devices and methods that permit injection of coiled tubing into the core end of a coiled tubing section lend themselves to particular use wherein there are separate reels of coiled tubing. The inventor has recognized that this technique permits the whip ends of the separate coiled tubing sections to be interconnected.

An exemplary method of disposing tubewire into coiled tubing is described wherein two separate reels of coiled tubing sections are provided. A high-pressure conduit is affixed to the core end of the coiled tubing of the first reel. Tubewire is pumped through the high-pressure hose and the coiled tubing of the first reel. Thereafter, the whip end of the coiled tubing of the first reel is interconnected with the whip end of the coiled tubing of the second reel with a coil-to-coil connector. The tubewire is then pumped through the coiled tubing of the second reel from the whip end of the coiled tubing to its core end. Once this is done, the interconnected coiled tubing sections can be spooled onto a single reel, allowing it to be injected into a wellbore.

An alternative method of disposing tubewire into coiled tubing on multiple reels is described. According to this method, separate coiled tubing sections are initially spooled upon separate first and second reels. Prior to injecting tubewire into the coiled tubing, the whip ends of the coiled tubing sections on each reel are joined together using a coil-to-coil connector or in other ways known in the art. Tubewire is then injected into the core end of the coiled tubing section on the first reel. The injected tubewire then passes through the connection of the coiled tubing sections and into the coiled tubing section of the second reel. The injected tubewire can then exit through the core end of the coiled tubing section of the second reel. Thereafter, the interconnected coiled tubing sections with tubewire within can be reeled onto a single reel.

A further method for disposing tubewire into two separate sections of coiled tubing is described. According to this method, the whip ends of the coiled tubing on each of the first and second reels are interconnected. Then the interconnected coiled tubing sections are spooled onto a single reel. Tubewire is injected either into the core end of interconnected coiled tubing sections and through both sections or into the whip end of interconnected coiled tubing sections and through both sections.

Another method for disposing tubewire into two separate section of coiled tubing is also described. In accordance with this method, first and second reels of coiled tubing are provided. A first section of tubewire is injected into the coiled tubing section on the first reel, and a second section of tubewire is injected into the coiled tubing section on the second reel. The tubewire on the first reel is then interconnected with the tubewire of the second reel. Thereafter, the two coiled tubing sections are interconnected. At this point, the interconnected coiled tubing sections are spooled onto a single reel.

Exemplary methods are described for removing tubewire from a coiled tubing string that is made up of multiple sections of coiled tubing. According to one method, the entire tubewire is pumped out of the coiled tubing in the conventional manner using the coiled tubing injector while the multiple sections of coiled tubing are still spooled on one reel. Once the tubewire is removed, the coil is then separated into separate sections and spooled onto separate reels for transport.

An alternative method for removing the tubewire from the coiled tubing is described. In accordance with this method, a portion of coiled tubing is spooled onto the second reel. When the coil-coil connection between coiled tubing sections emerges from the first reel, spooling is stopped. Tubewire is pumped out of the coiled tubing via the core end of the second reel until the end of the tubewire is located at the coil-coil connection point of the coiled tubing sections, at which point tubewire retrieval is stopped. The coil-coil connector is removed, thereby disconnecting the two sections of coiled tubing. Treating iron is then attached to the whip end of the second coil and the tubewire is fully retrieved from the second coil via the core end of the second coil.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

The term "tubewire", as used herein, refers to a tube which may or may not encapsulate a conductor or other communication means, such as, for example, the tubewire manufactured by Draka Cableteq of North Dighton, Mass. Tubewire for example, might consist of a ⅛" outer diameter by 0.023" wall of stainless steel or Incoloy 825 tube containing 16-18 gauge stranded copper wire covered by Halar™ or Teflon™ insulator. In this example, the insulator is tight against the tube and the wire. In the alternative, the tubewire may encapsulate one or more fiber optic cables or a mixture of wire(s) and fiber optic cable(s). The tubewire may consist of multiple tubes and may be concentric or may be coated on the outside with plastic or rubber.

Figure 1:
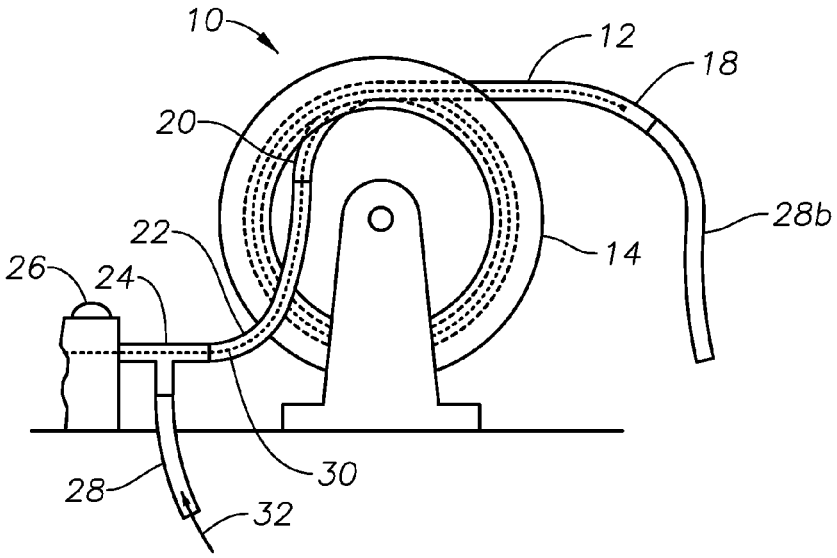
FIG. 1 is a side view of an exemplary coiled tubing arrangement wherein a tubewire is injected into the core end of a single coiled tubing section.

FIG. 1 illustrates an exemplary arrangement wherein tubewire is being injected into the core end of a spool of coiled tubing 10. Coiled tubing section 12 is shown wrapped onto a coiled tubing reel or spool 14. The coiled tubing section 12 presents a whip end 18 and a core end 20. The core end 20, as used herein, will refer to the end of a coiled tubing section that is located nearest the center of the reel. As the coiled tubing section is wrapped around the reel, the whip end 18 will be the end that is furthest away from the center of the reel. It is noted that, in each embodiment to be described, the coiled tubing section 12 could come off the top of the reel 14, as shown in FIG. 1 or be reeled in the opposite direction and come off the bottom of the reel 14. A conduit in the form of a high pressure flexible hose 22 is affixed to the core end 20. The conduit 22 functions to provide a smooth flowpath for fluid and a guide path for tubewire being pumped into the core end 20. In alternative embodiments, the conduit 22 could comprise a solid pipe or made up of separate sections of hose and pipe so long as a relatively smooth, gently arcing, high pressure flow path is provided for fluid and tubewire being injected. In some alternative embodiments, a section of bent coiled tubing is used as the conduit 22. A high pressure tee 24 is secured to the conduit 22. The tee 24 is used to join the conduit 22 to a tubewire injector 26 of a type known in the art.

The tubewire injector 26 is hydraulically driven and controlled. However, it could be electrically driven and controlled or some combination of the two. Preferably, the injector 26 has a drive mechanism adapted to apply an axial pushing force to tubewire in order to inject the tubewire into the coiled tubing. Preferably, the injector can also apply an axial pulling force on the tubewire in order to retrieve the tubewire. Preferably, the tubewire injector 26 includes a drive mechanism that will drive the tubewire at a preselected speed or rate so that tension is maintained on the tubewire during injection and retrieval. The tubewire injector 26 can further include a control system to regulate injector forces, such as spool speed, drive mechanism speed and fluid pressure, at levels desirable for injection or removal of the tubewire.

A treating iron 28 is also affixed to the tee 24. A treating iron **28*b* is also affixed to the whip end 18. Tubewire 30 is shown being injected by the tubewire injector 26 into the core end 20 of the coiled tubing 12. Fluid is flowed through the treating iron 28 into the tee 24 in the direction of arrow 32, through the coil 12 and out the treating iron 28***a*. As tubewire 30 exits the injector 26, the fluid helps to pass the tubewire 30 through the tee 24, conduit 22 and coiled tubing 12. The tubewire 30 enters the core end 20 of the coiled tubing 12 and moves toward the whip end 18.

Figure 2:
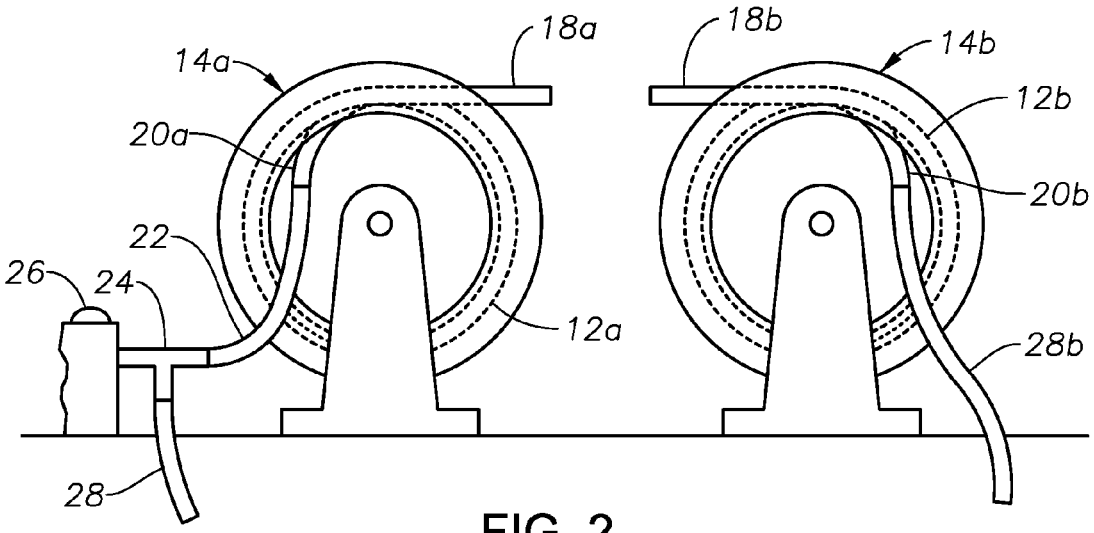
FIG. 2 is a side view of an exemplary coiled tubing arrangement having two separate reels, each reel carrying a separate section of coiled tubing.

FIG. 2 illustrates an arrangement wherein there are two reels 14*a*, 14*b*. Each of the reels 14*a*, 14*b* has a section of coiled tubing wrapped thereupon. Coiled tubing section 12*a* is wrapped onto reel 14*a* while coiled tubing section 12*b* is wrapped onto reel 14*b*. Each coiled tubing section 12*a*, 12*b* presents a core end 20*a*, 20*b* and a whip end 18*a*, 18*b*. It is desired to inject tubewire 30 into both the coiled tubing sections 12*a* and 12*b*.

Figure 3:
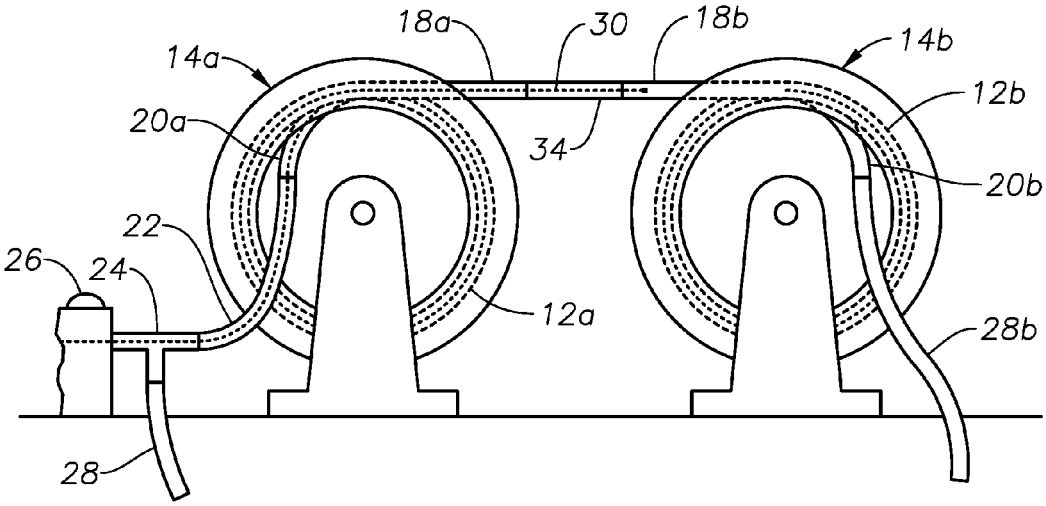
FIG. 3 is a side view of the exemplary coiled tubing arrangement shown in FIG. 2, now with the coiled tubing section of each reel interconnected.
Figure 5:
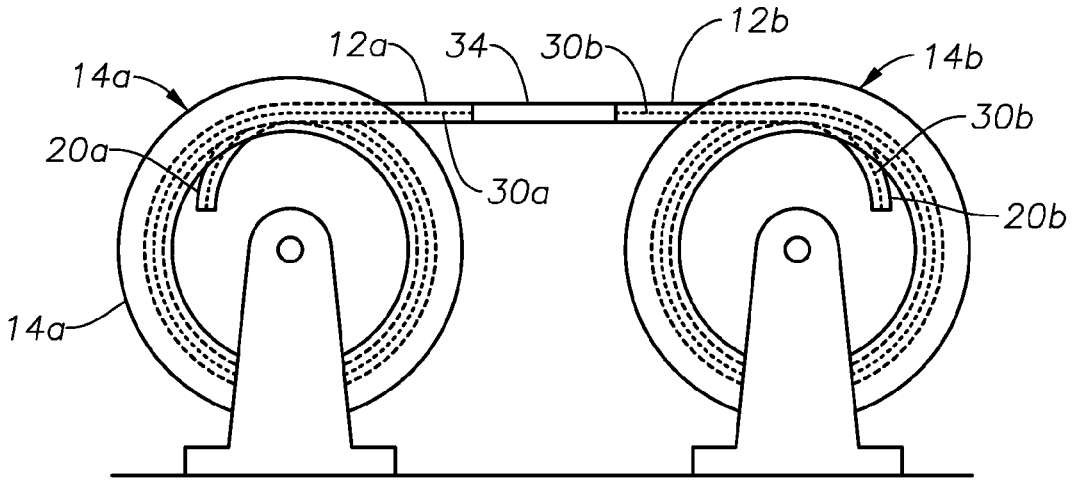
FIG. 5 is a side view of the coiled tubing arrangement shown in FIG. 4, now with the coiled tubing sections interconnected.
Figure 9:
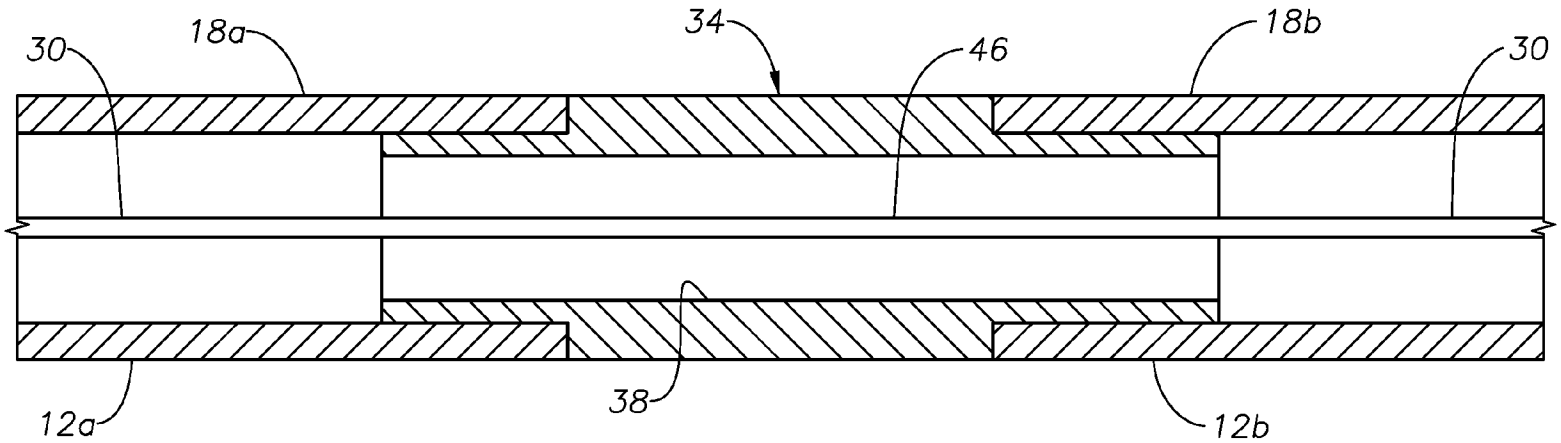
FIG. 9 is a side cross-section depicting another alternative exemplary interconnection of coiled tubing and tubewire.

According to a first method of disposing tubewire 30 into the coiled tubing sections 12*a*, 12*b*, tubewire 30 is first pumped through the conduit 22 and the coiled tubing section 12*a* to the whip end 18*a* of the first reel 14*a*, in the manner depicted in FIG. 1. Thereafter, the whip end 18*a* of the coiled tubing of the first reel 14*a* is interconnected with the whip end 18*b* of the coiled tubing section 12*b* of the second reel 14*b* with a coil-to-coil connector 34, as illustrated in FIGS. 3, 5 and 9 or by welding the two coil strings together. The tubewire 30 is then pumped through the coil-to-coil connector 34 and into the coiled tubing section 12*b* of the second reel from the whip end of the coiled tubing to its core end. FIG. 9 depicts the tubewire 30 located within the bore 38 of connector 34. Once this is done, the interconnected coiled tubing sections 12*a*, 12*b* can be spooled onto a single reel, such as 14*a*, allowing it to be injected into a wellbore.

According to an alternative method of disposing tubewire 30 into the coiled tubing sections 12*a*, 12*b*, separate coiled tubing sections 12*a*, 12*b* are initially spooled upon separate first and second reels 14*a*, 14*b*, as depicted in FIG. 2. Prior to injecting tubewire 30 into the coiled tubing section 12*a*, 12*b*, the whip ends 18*a*, 18*b* of the coiled tubing sections 12*a*, 12*b* on each reel 14*a*, 14*b* are joined together using a coil-to-coil connector 34 or by welding the two coil strings together. Tubewire 30 is then injected into the core end 20*a* of the coiled tubing section 12*a* on the first reel 14*a*. The injected tubewire 30 then passes through the connector 30 and into the coiled tubing section 12*b* of the second reel 14*b* (see FIG. 3). The injected tubewire 30 can then exit through the core end 20*b* of the coiled tubing section 12*b* of the second reel 14*b*. Thereafter, the interconnected coiled tubing sections 12*a*, 12*b* with tubewire 30 within can then be reeled onto a single reel.

According to a further method of disposing tubewire into two separate coiled tubing sections, the whip ends 18*a*, 18*b* of the coiled tubing sections 12*a*, 12*b* on each of the first and second reels 14*a*, 14*b* are interconnected. Then the interconnected coiled tubing sections 12*a*, 12*b* are spooled onto a single reel. Tubewire 30 is injected into the new core end 20 or the new whip end 18 of the interconnected coiled tubing sections and through both coiled tubing sections 12*a*, 12*b*.

Figure 4:
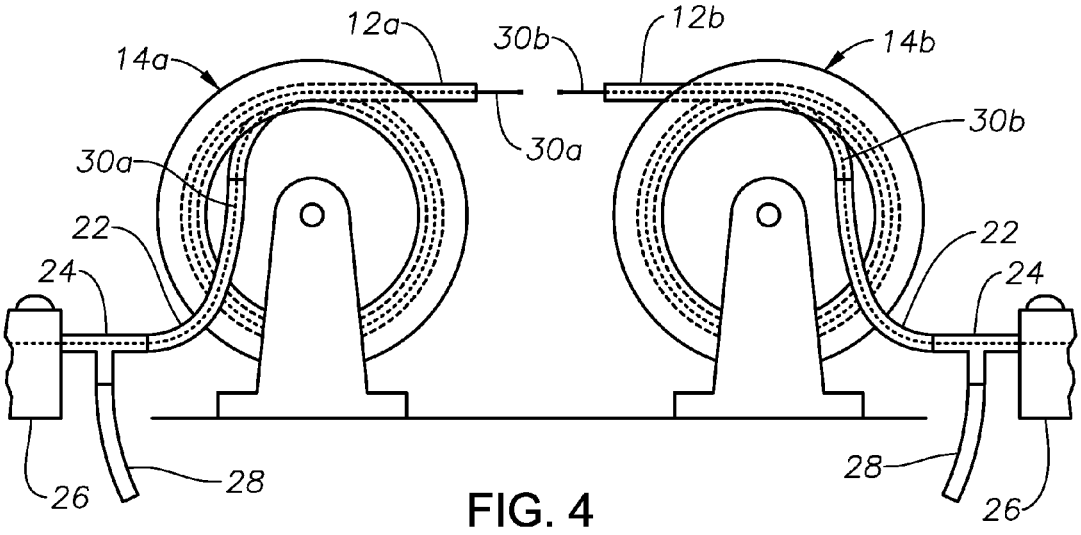
FIG. 4 is a side view of an exemplary coiled tubing arrangement wherein each reel carries a separate section of coiled tubing and tubewire has been injected into each coiled tubing section.
Figure 6:
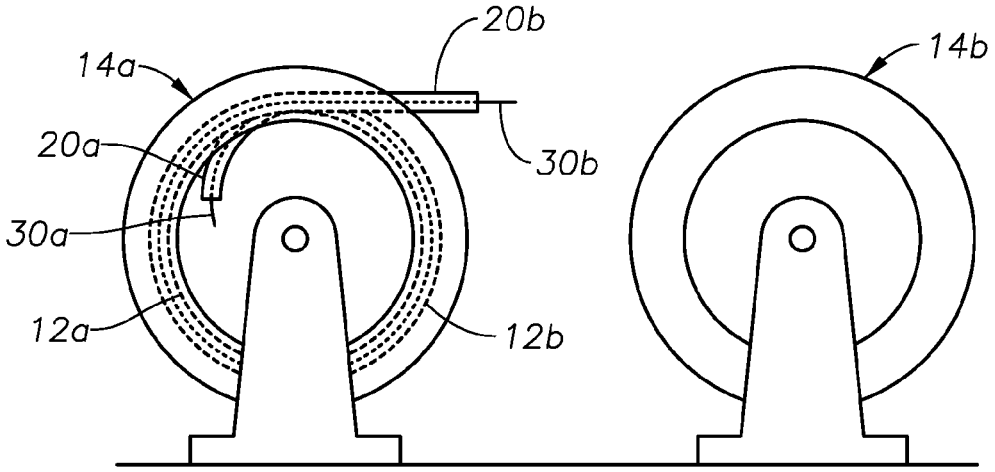
FIG. 6 is a side view of the coiled tubing arrangement shown in FIGS. 4-5, now with the interconnected coiled tubing sections wound onto a single coil.

Another method for disposing tubewire 30 into two separate sections of coiled tubing 12*a*, 12*b* is illustrated by FIGS. 4-6. First and second reels 14*a*, 14*b* of coiled tubing are provided. A first section of tubewire 30*a* is injected into the core end 20*a* of the coiled tubing section 12*a* on the first reel 14*a*, and a second section of tubewire 30*b* is injected into the core end 20*b* of the coiled tubing section 12*b* on the second reel 14*b*, as illustrated in FIG. 4. Alternatively, the two sections of tubewire could be injected into the reels from the whip end as described in the '419 patent. Alternatively, one long piece of tubewire 30 could be injected into one long section of coiled tubing 12 and then the coiled tubing 12 and tubewire 30 could be cut into segments of transportable lengths and placed onto separate reels. The tubewire section 30*a* on the first reel 14*a* is then interconnected with the tubewire section 30*b* of the second reel 14*b*, and the two coiled tubing sections 12*a*, 12*b* are interconnected (see FIG. 5) by a connector 34 or by welding. At this point, the interconnected coiled tubing sections 12*a*, 12*b* and tubewire sections 30*a*, 30*b* are spooled onto a single reel (14*a* in FIG. 6). Now, the coiled tubing sections 12*a*, 12*b* and tubewire sections 30*a*, 30*b* are interconnected and in a configuration wherein they can be injected into a wellbore in a manner known in the art.

Figure 7:
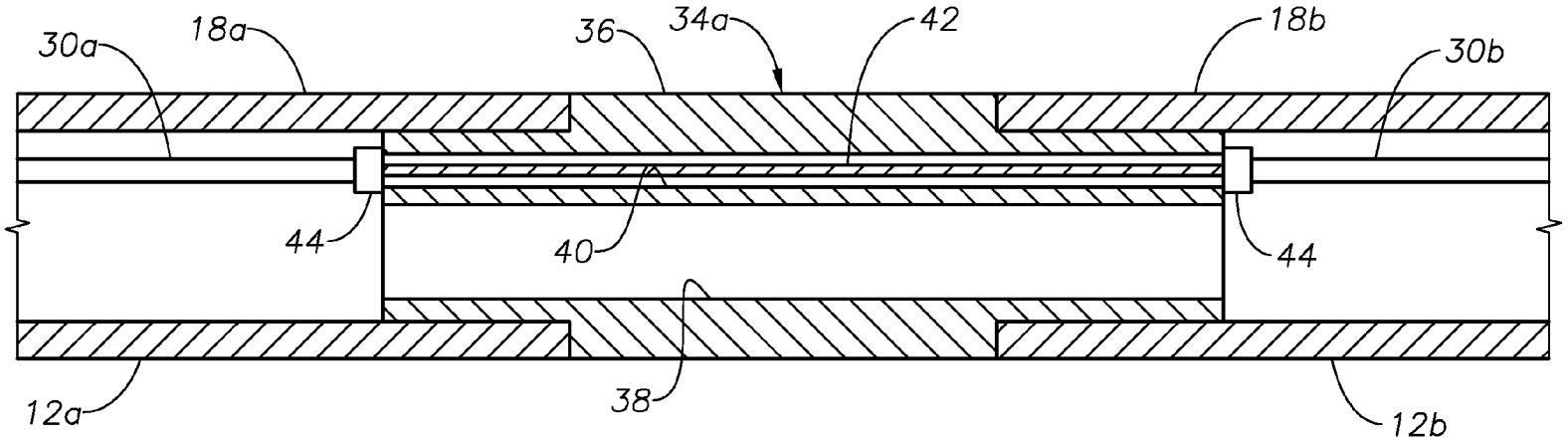
FIG. 7 is a side cross-section depicting an exemplary interconnection of coiled tubing and tubewire.
Figure 8:
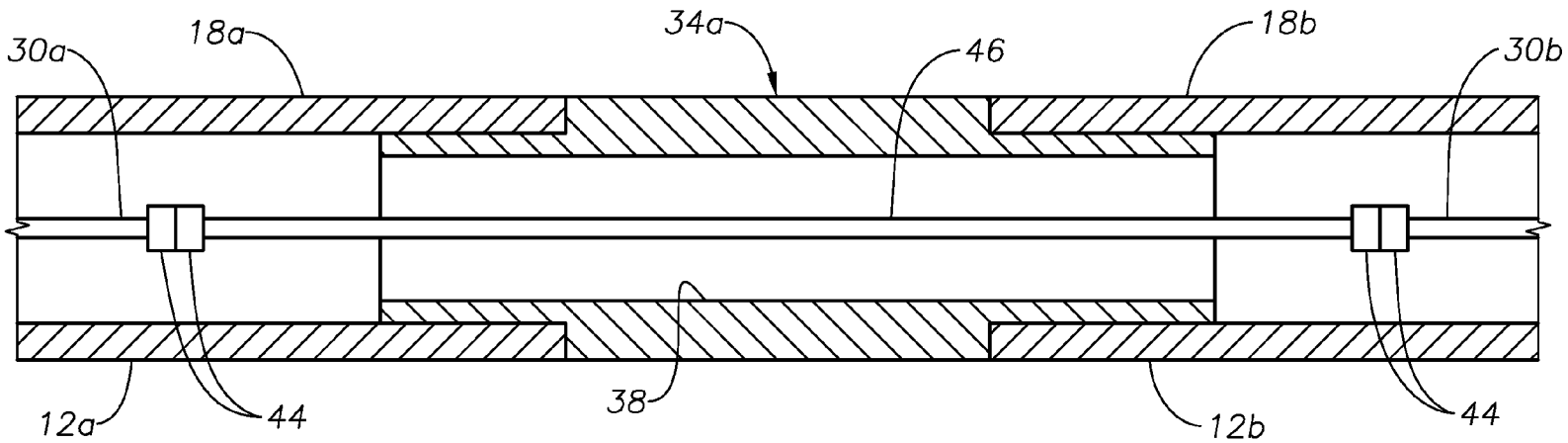
FIG. 8 is a side cross-section depicting an alternative exemplary interconnection of coiled tubing and tubewire.
Figure 10:
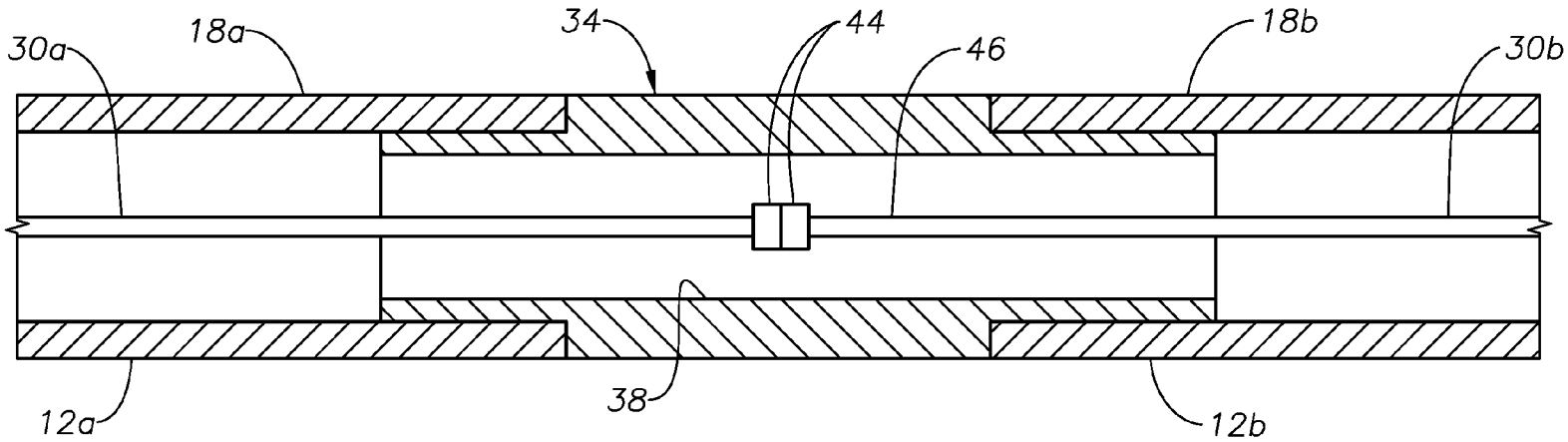
FIG. 10 is a side cross-section depicting a further alternative exemplary interconnection of coiled tubing and tubewire.

FIGS. 7, 8 and 10 illustrate exemplary methods for joining the whip ends 18*a*, 18*b*, and more specifically the tubewire sections 30*a* and 30*b*. Although FIG. 5 illustrates a generic connection 34, the constructions shown in FIG. 7, 8 or 10 provide further detail and either construction can suffice for the generic connection 34 shown in FIG. 5. In FIG. 7, coil connector 34*a* includes a tubular connector body 36 which defines an axial flowbore 38 along its length. The coil connector 34*a* may be securely affixed to the coiled tubing sections 12*a*, 12*b* using dimple-style or internal grapple connectors, which are known in the art, or using other known methods. In addition, a conductor passage 40 is defined along the length of the connector body 36. A linear conductive rod or wire 42 is disposed within the conductor passage 40. The separate tubewire sections 30*a*, 30*b* are secured together by use of tubewire connectors 44 thereby permitting electric transmission between the tubewire sections 30*a*, 30*b* via the conductive rod/wire 42. Fluid flow between the coiled tubing sections 12*a*, 12*b* is accomplished via the flowbore 38.

FIG. 8 illustrates an alternative coil connector 34*b* which includes an axial flowbore 38 defined along its length. However, there is no conductor passage 40 or rod/wire 42. A tubewire bridge segment 46 is secured to each of the tubewire sections 30*a*, 30*b* with tubewire connectors 44, thereby permitting electric transmission between the tubewire sections 30*a*, 30*b*. The tubewire bridge segment 46 may be an actual segment of tubewire. Alternatively, any suitable generic tube with conductive wire within, or encapsulated wire, could be used as the tubewire bridge segment 46. Fluid flow between the coiled tubing sections 12*a*, 12*b* is accomplished via the flowbore 38.

FIG. 10 illustrates an alternative coil connection which includes a coil connection 34 having axial flowbore 38. Tubewire sections 30*a*, 30*b* are directly connected together with a tubewire connector 44, thereby permitting electric transmission between the tubewire sections 30*a*, 30*b*. Fluid flow between the coil sections 18*a*, 18*b* is accomplished via the flowbore 38.

Tubewire sections 30*a*, 30*b* and coiled tubing sections 12*a*, 12*b*, which are joined together using one of the previously described techniques, can be injected into a wellbore after having been coiled onto a single reel, as depicted in FIG. 6. Selected tools are connected to the coiled tubing 12 and tubewire 30 prior to running in, as is known in the art.

In accordance with withdrawal of the coiled tubing 12 and tubewire 30 from the wellbore, a number of methods may be used to remove the joined tubewire sections 30*a*, 30*b* from within the coiled tubing sections 12*a*, 12*b* and return the coiled tubing sections 12*a*, 12*b* to their individual reels 14*a*, 14*b*.

Figure 11:
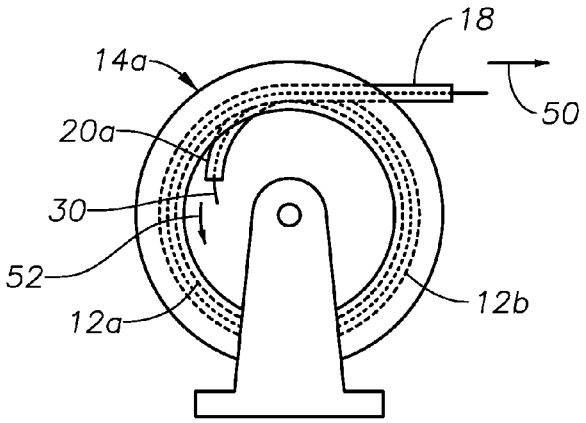
FIG. 11 is a side, cross-section depicting removal of tubewire from first and second coiled tubing sections spooled onto a single reel.

According to a first method of removal, which is illustrated in FIG. 11, once the combined coiled tubing sections 12*a*, 12*b* are removed from the wellbore and fully spooled onto one reel 14*a*, the entire tubewire 30 is removed from the coiled tubing 12 by pumping and using the coiled tubing injector 26. The tubewire 30 can be removed out of the whip end 18 of the combined coiled tubing sections 12*a*, 12*b* (as indicated by arrow 50 in FIG. 11) or, alternatively, removed out of the core end 20 of the combined sections (as indicated by arrow 52 in FIG. 11). When the tubewire 30 is removed from the coiled tubing 12, the coiled tubing 12 is then separated into separate sections 12*a*, 12*b* and spooled onto separate reels 14*a*, 14*b* for transport. This method would be suitable for the instances where the tubewire 30 is comprised of only one continuous piece of tubewire. This method would also be suitable for instances where tubewire sections 30*a* and 30*b* are connected with one tubewire connector 44, as depicted in FIG. 10. This method would be unsuitable in instances wherein the coiled tubing sections 12*a*, 12*b* and tubewire sections 30*a*, 30*b* are secured together using the connector 34*a* depicted in FIG. 7 since the tubewire sections 30*a*, 30*b* could not be removed from the coiled tubing 12 without also disconnecting the coiled tubing 12*a* and 12*b* from the connector 34*a* and removing the connector 34*a*.

According to a second method for removing the tubewire 30 from the coiled tubing 12, in instances wherein the coiled tubing sections 12*a*, 12*b* and tubewire sections 30*a*, 30*b* are secured together using a connector 34 as depicted in FIG. 7, 8 or 10, once the combined coiled tubing sections 12*a*, 12*b* are removed from the wellbore and fully spooled onto one reel 14*a* (see FIG. 6), a portion of coiled tubing 12 is spooled from the reel 14*a* onto a second reel 14*b* (see FIG. 5) prior to removing tubewire 30 from the coiled tubing 12. First, coiled tubing section 12*b* (with tubewire section 30*b* within) spooled onto the second reel 14*b*. When the connector 34 between the coiled tubing sections 12*a*, 12*b* emerges from the first reel 14*a*, the spooling is stopped and the two coiled tubing sections 12*a*, 12*b* are uncoupled at the connector 34. The tubewire sections 30*a*, 30*b* are then uncoupled at connector(s) 44, thereby fully separating both reels 14*a*, 14*b* for transport. Tubewire sections 30*a*, 30*b* are then removed, if necessary, from each separate reel 14*a*, 14*b* of coiled tubing either from the core end 20 of each reel 14*a*, 14*b* or from the whip end 18 of each reel 14*a*, 14*b*. The flexible hose 22 will provide a suitable flow path for removal of the tubewire 30 in the case of pumping the tubewire 30 out of the core end 20.

Figure 12:
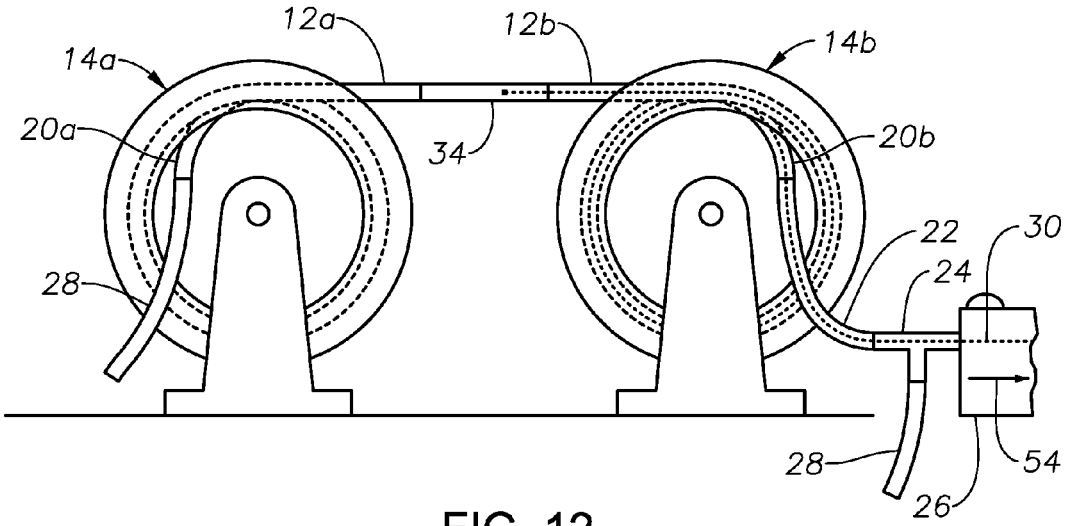
FIG. 12 is a side, cross-section depicting partial removal of tubewire from within coiled tubing sections spooled onto separate reels.
Figure 13:
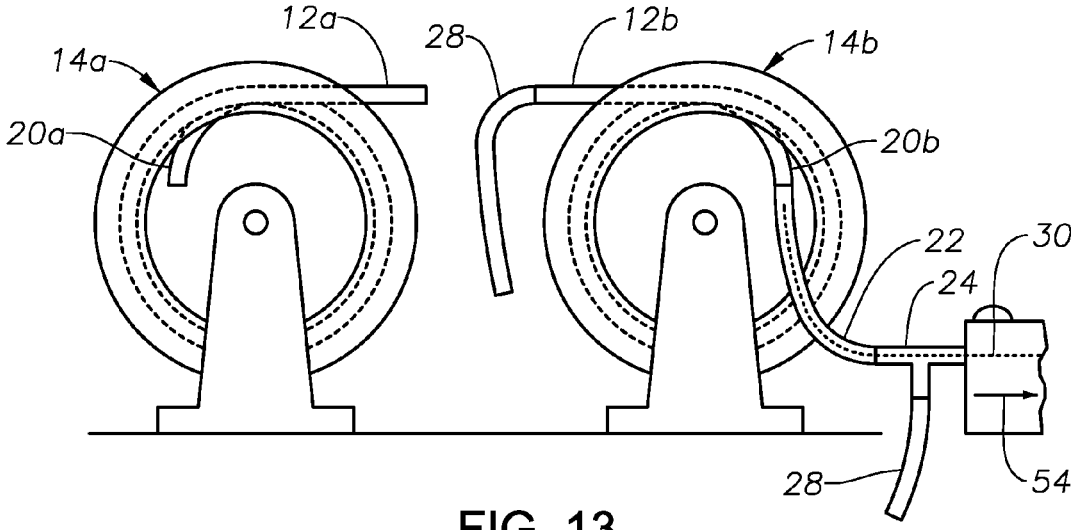
FIG. 13 is a side, cross-section depicting further removal of tubewire from the coiled tubing sections shown in FIG. 12.

A further method may be used to remove tubewire 30 from coiled tubing 12 in instances wherein the tubewire 30 is comprised of one continuous piece of tubewire 30. However, it can also be used where there are interconnected sections of tubewire. Once the combined coiled tubing sections 12*a*, 12*b* are removed from the wellbore and fully spooled onto one reel 14*a*, a portion of coiled tubing 12 is spooled from the reel 14*a* and onto a second reel 14*b* prior to removing tubewire 30 from the coiled tubing 12. First, coiled tubing section 12*b* is spooled onto the second reel 14*b* from first reel 14*a*. When the connection point provided by connector 34 between the coiled tubing sections 12*a*, 12*b* emerges from the first reel 14*a* (see position illustrated by FIG. 5), the spooling is stopped. The tubewire 30 is then removed from the coiled tubing section 12*a* via the core end 20*b* of reel 14*b* by pumping in the direction of arrow 54 (FIG. 12), using the coiled tubing injector 26 and by using the conduit 22 (see FIG. 12). When the end of the tubewire 30 is located within the connector 34, the tubewire retrieval is stopped and the connector 34 is disconnected, thereby separating coiled tubing section 12*a* (now empty of tubewire) from coiled tubing section 12*b* (still containing tubewire 30) for removal and transport. The remaining tubewire 30 in coiled tubing section 12*b* is then removed from the coiled tubing section 12*b* (see FIG. 13) via the core end 20*b* of the reel 14*b* by pumping, using the coiled tubing injector 26 and the conduit 22.

Those of skill in the art will recognize that numerous modifications and changes may be made to the exemplary designs and embodiments described herein and that the invention is limited only by the claims that follow and any equivalents thereof.

What is claimed is:

1. A method of disposing tubewire into coiled tubing, the method comprising the steps of:

providing a first coiled tubing section coiled upon a first reel, the first coiled tubing section providing a core end and a whip end;

injecting tubewire within the core end of the first coiled tubing section toward the whip end, while the first coiled tubing section is coiled upon the reel;

providing a second coiled tubing section coiled upon a second reel, the second coiled tubing section providing a core end and a whip end;

injecting tubewire within the core end of the second coiled tubing section toward the whip end;

interconnecting the tubewire that has been injected into the first coiled tubing section with the tubewire that has been injected into the second coiled tubing section; and directly interconnecting the whip end of the first coiled tubing section with the whip end of the second coiled tubing section.

2. The method of claim 1 further comprising the step of affixing a conduit to the core end of the first coiled tubing section prior to injecting the tubewire in order to provide a suitable flowpath and guide path for injection of tubewire.

3. The method of claim 1 further comprising the steps of:

providing a second coiled tubing section coiled upon a second reel, the second coiled tubing section providing a core end and a whip end; and interconnecting the whip end of the first coiled tubing section with the whip end of the second coiled tubing section.

4. The method of claim 3 further comprising the step of further injecting the tubewire into the whip end of the interconnected second coiled tubing section.

5. The method of claim 3 wherein the step of interconnecting the whip end of the first coiled tubing section with the whip end of the second coiled tubing section further comprises affixing the whip ends of the first and second coiled tubing sections to a coil-to-coil connector.

6. The method of claim 1 further comprising the steps of:

providing a second coiled tubing section coiled upon a second reel, the second coiled tubing section providing a core end and a whip end; and injecting tubewire within the whip end of the second coiled tubing section toward the core end.

7. The method of claim 1 wherein the tubewire within the first coiled tubing section is interconnected with the tubewire within the second coiled tubing section by interconnecting a tubewire bridge segment to each.

8. The method of claim 1 wherein the tubewire within the first coiled tubing section is interconnected with the tubewire within the second coiled tubing section by a conductive rod or wire.

9. A method of disposing tubewire into coiled tubing, the method comprising the steps of:

providing a first coiled tubing section coiled upon a first reel, the first coiled tubing section providing a core end and a whip end;

affixing a conduit to the core end of the first coiled tubing section prior to injecting the tubewire in order to provide a suitable flowpath for injection of tubewire;

injecting tubewire within the core end of the first coiled tubing section toward the whip end, while the first coiled tubing section is coiled upon the reel;

providing a second coiled tubing section coiled upon a second reel, the second coiled tubing section providing a core end and a whip end;

injecting tubewire within the core end of the second coiled tubing section toward the whip end;

interconnecting the tubewire that has been injected into the first coiled tubing section with the tubewire that has been injected into the second coiled tubing section; and directly interconnecting the whip end of the first coiled tubing section with the whip end of the second coiled tubing section.

10. The method of claim 9 further comprising the steps of:

providing a second coiled tubing section coiled upon a second reel, the second coiled tubing section providing a core end and a whip end; and interconnecting the whip end of the first coiled tubing section with the whip end of the second coiled tubing section.

11. The method of claim 10 further comprising the step of further injecting the tubewire into the whip end of the interconnected second coiled tubing section.

12. The method of claim 11 further comprising the step of spooling the interconnected first and second coiled tubing sections onto a single reel.

13. The method of claim 10 wherein the step of interconnecting the whip end of the first coiled tubing section with the whip end of the second coiled tubing section further comprises affixing the whip ends of the first and second coiled tubing sections to a coil-to-coil connector.

14. The method of claim 9 wherein the tubewire within the first coiled tubing section is interconnected with the tubewire within the second coiled tubing section by interconnecting a tubewire bridge segment to each.

15. The method of claim 9 wherein the tubewire within the first coiled tubing section is interconnected with the tubewire within the second coiled tubing section by a conductive rod or wire.

16. A method of removing a tubewire from within a coiled tubing, the method comprising the steps of:

providing a first reel having first and second coiled tubing sections coiled thereupon, the first and second being interconnected and having tubewire disposed within both the first and second coiled tubing sections;

removing the tubewire from the first and second coiled tubing sections by:

unspooling the first coiled tubing section from the first reel until a connection point between the first and second coiled tubing sections is revealed;

removing tubewire from within the first coiled tubing section until an end of the tubewire reaches a point proximate the connection point;

disconnecting the first and second coiled tubing sections at the connection point; and removing tubewire from the second coiled tubing section.

17. The method of claim 16 wherein the step of removing the tubewire from the first and second coiled tubing sections comprises:

removing tubewire completely from the first and second coiled tubing sections without unspooling the first and second coiled tubing sections from the first reel.

18. The method of claim 16 wherein the tubewire comprises first and second tubewire portions that are interconnected, and wherein the step of removing the tubewire from the first and second coiled tubing sections comprises:

unspooling the first coiled tubing section from the first reel until a connection point between the first and second coiled tubing sections is revealed;

disconnecting the first and second coiled tubing sections at the connection point;

disconnecting the first and second tubewire portions from each other; and removing the first and second tubewire portions from the first and second coiled tubing sections.

* * * * *